US006216935B1

(12) United States Patent
Oussani, Jr. et al.

(10) Patent No.: US 6,216,935 B1
(45) Date of Patent: Apr. 17, 2001

(54) ADJUSTABLE FORCE POWERIZED STAPLER

(75) Inventors: James J. Oussani, Jr.; Gregory P. Oussani, both of Brooklyn, NY (US)

(73) Assignee: The Staplex Company, Inc., Brooklyn, NY (US)

( * ) Notice: Subject to any disclaimer, the term of this patent is extended or adjusted under 35 U.S.C. 154(b) by 0 days.

(21) Appl. No.: 09/260,945

(22) Filed: Mar. 2, 1999

(51) Int. Cl.[7] ..... B25C 1/05

(52) U.S. Cl. ..... 227/6; 227/5; 227/131; 227/142

(58) Field of Search ..... 227/131, 8, 142, 227/7, 5, 6, 2

(56) References Cited

U.S. PATENT DOCUMENTS 3,345,546 * 10/1967 Beltramo ..... 227/131
3,346,163 * 10/1967 Manganaro ..... 227/131
4,524,897 * 6/1985 Bachmann ..... 227/131
4,592,502 * 6/1986 Judge ..... 227/131
4,611,742 * 9/1986 Rieker et al. ..... 227/131
5,161,724 * 11/1992 Radtke et al. ..... 227/7
5,354,042 * 10/1994 Coombs ..... 227/5
5,671,879 * 9/1997 Lin ..... 227/131

* cited by examiner

*Primary Examiner*—Scott A. Smith
(74) *Attorney, Agent, or Firm*—Paul J. Sutton

(57) ABSTRACT

A powerized stapler device is disclosed including an electromagnet, preferably a solenoid, having a armature which is adjustable relative to the solenoid such that the permeable portions of the armature, in the non-energized condition of the solenoid, may be adjusted relative to the solenoid enabling the force exerted by the solenoid to be varied as a function of the initial position of the armature. In a further preferred embodiment, an extension of the armature is engaged with the stapler head whereby movements of the armature relative to the electromagnet also function to vary the space between the stapler head and the stapler anvil, adjustments to process thin work pieces functioning to reduce the spacing between stapler head and anvil as well as reducing the driving force exerted by the electromagnet. In a preferred embodiment, a sensor mechanism is provided which mechanically urges the stapler head toward or away from the anvil and shifts the position of the armature into or out of the core of a solenoid in accordance with the thickness of the work piece as sensed by the sensor mechanism.

9 Claims, 6 Drawing Sheets

FIG. 1
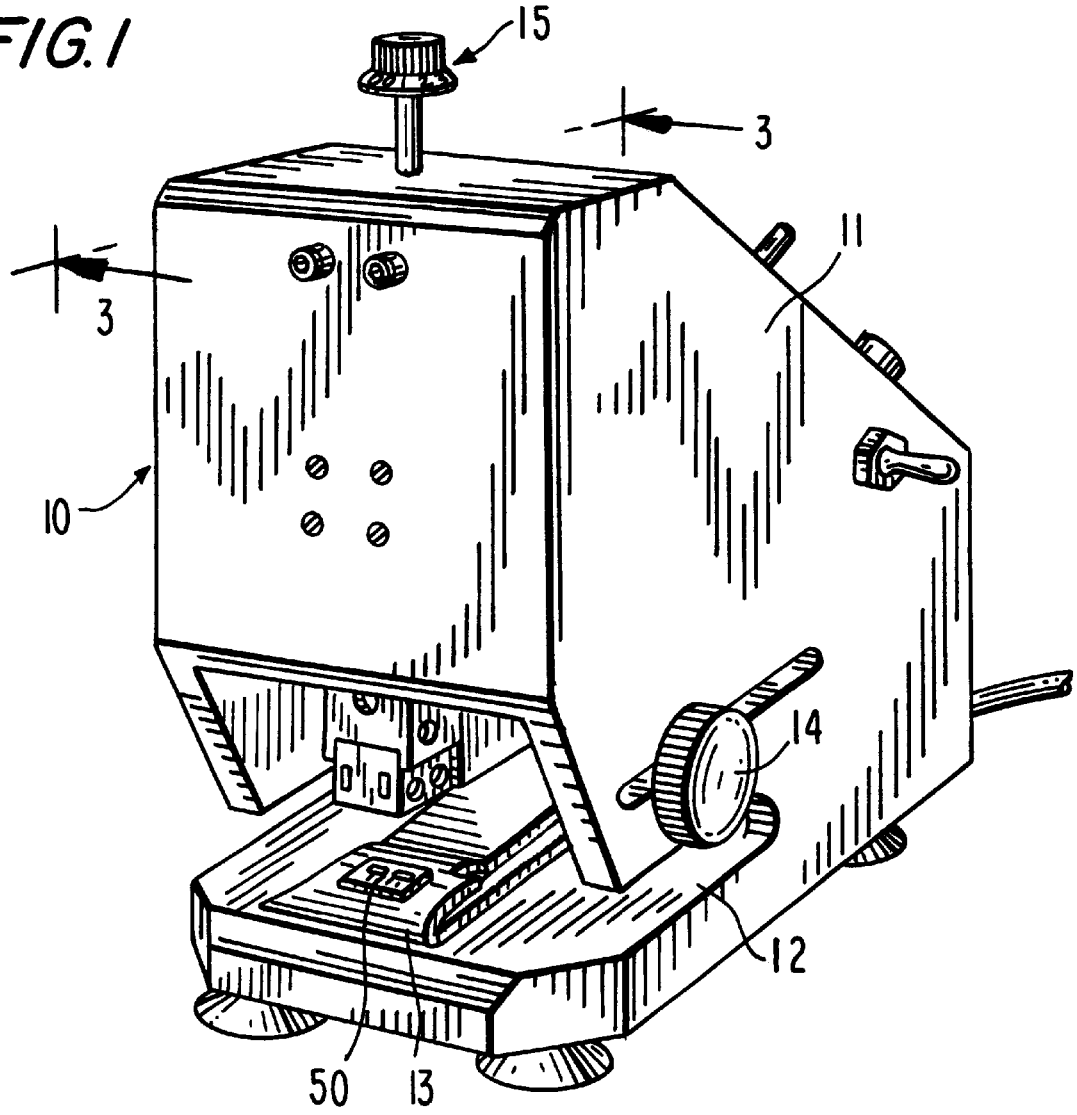
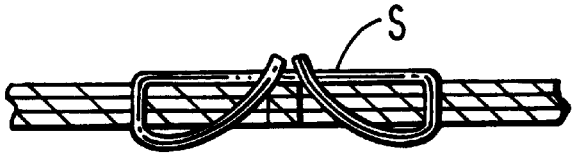
FIG. 2a
PRIOR ART
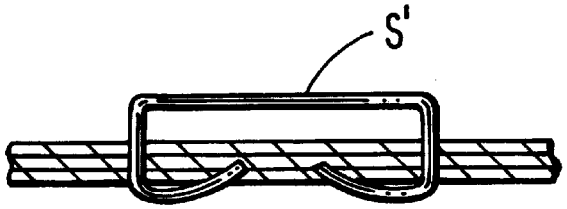
FIG. 2b
PRIOR ART

FIG. 5
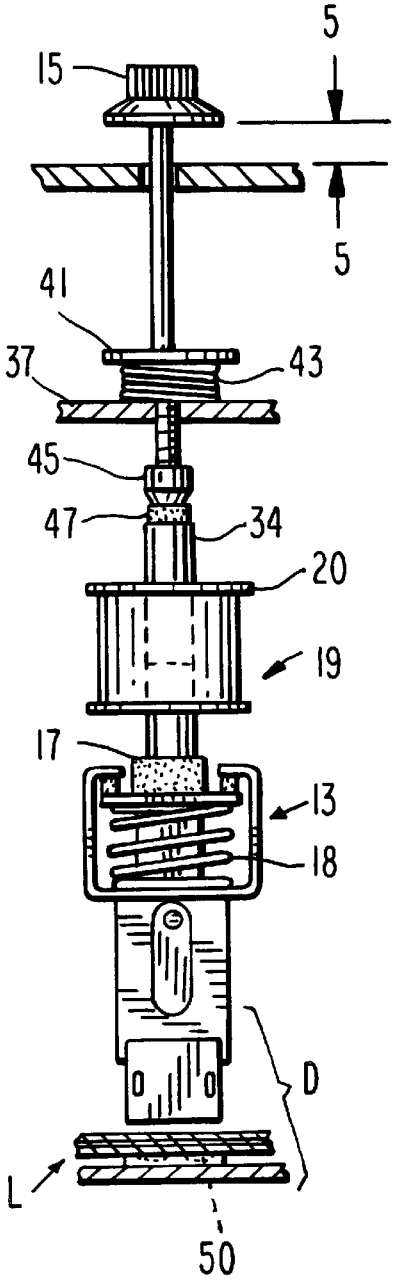
FIG. 7
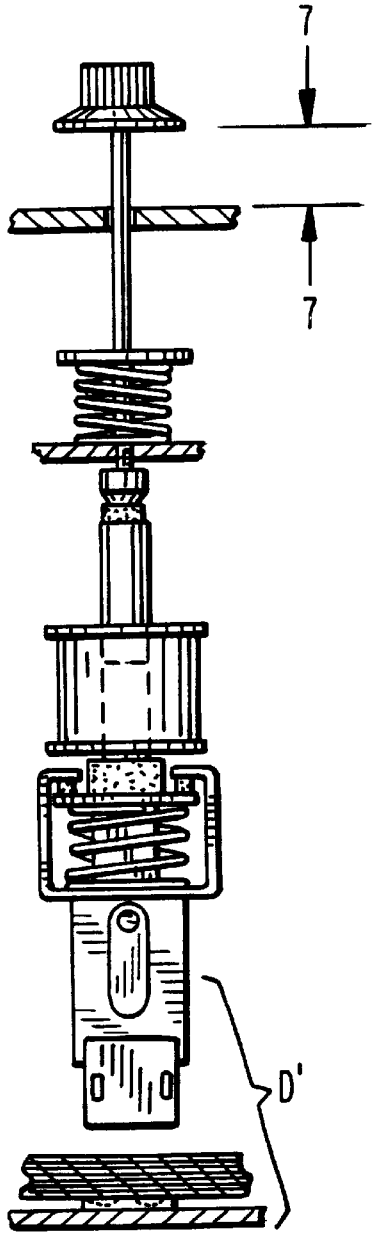
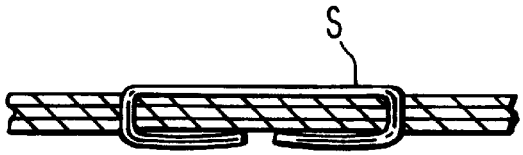
FIG. 6
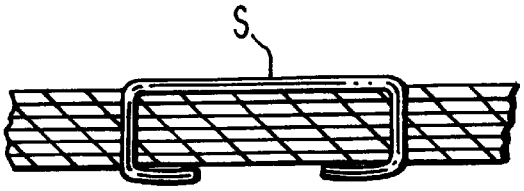
FIG. 8

ADJUSTABLE FORCE POWERIZED STAPLER

BACKGROUND AND FIELD OF THE INVENTION

The present invention is directed to a powerized stapler device and more particularly to a stapler device wherein the driving force imparted to the head of the stapler may be varied within a wide range such that a greater driving force is applied when a multiplicity of sheets are to be stapled and conversely, a lower driving force is applied where the staple is to be clinched through a limited number of sheets.

1. Prior Art

Powerized stapling devices have been available for many years, representative examples being disclosed in U.S. Pat. Nos. 2,403,947; 2,877,461; 2,957,174; 2,975,424; 3,016,538; 3,022,512; 3,026,518; 3,101,478; 3,151,329; 3,251,524, assigned to the assignee hereof. The references noted disclose, in general, staplers integrated into a housing, carrying an electromagnetic mechanism such as a solenoid, the armature of the solenoid being disposed above the drive head of the stapler. Insertion of articles to be stapled activates a switch mechanism energizing the solenoid and causing the armature to drive the stapler through an operating cycle A difficulty inhering in staplers of the type described resides in the fact that the stapling force imparted is identical for stapling jobs consisting of a multiplicity of sheets and also for jobs involving only a few sheets. Where the applied force is sufficient for joining multiple sheets and the same force is utilized in joining jobs comprised of only a few sheets, one or the other of the jobs will be defective. More particularly, if the force is insufficient to drive a staple through a multiple sheet job, an effective clinching will not result. Conversely, if a force sufficient for multiple sheet stapling is utilized in connection with a two or three sheet job, the stapler will act in the manner of a punch, the base of the overdriven staple penetrating one or more of the sheets whereby the upper most ones of the sheets are not effectively connected to the remainder of the sheets.

A further problem inhering in the application of overly great stapling forces when connecting a limited number of sheets, resides in the excessive impact leaving an imprint surrounding the area of staple application.

A still further drawback of known powerized staplers, particularly when used to fasten a limited number of sheets, resides in the staple being applied with a rolling or angular clinch. The rolling clinch results from the fact that the sheets are moving a finite distance after the sensor, which activates the stapler, is energized. As a result, the legs of the staple penetrate the sheets while the sheets are still moving, whereby the base of the staple has passed a slight distance beyond the clinching anvil, resulting in a rolling or loosely applied staple. The described problem is of lesser significance where a multiplicity of sheets are to be stapled since the multiple sheets act as a support for the staple as it is driven. Additionally, the thickness of the multiple sheets assures that impact between the stapler head and the upper most sheet occurs promptly following energizing of the power mechanism since the upper most sheet of a thick stack will be closer to the stapler head than would be the case where only a few sheets are to be connected.

Various means have been proposed to provide stapling devices wherein the driving power may be adjusted. These known devices utilize electronic circuitry for varying the voltage applied to the solenoid or other electromagnetic driving means. While these devices enable the user to tailor the driving force, within a limited range, to the job at hand, they do not solve the problems discussed above, and particularly the problem of avoiding a rolling staple connection when used to join a limited number of sheets.

A further drawback of known powerized staplers resides in the fact that the power must be manually adjusted in accordance with the job at hand. Thus, where the user will sequentially staple thin and thick stacks of articles, adjustment must be manually effected between each application, greatly slowing the stapling procedure. Additionally, manual adjustment involves discretion on the part of the user and thus is a minimal aid to the occasional powerized stapler user.

SUMMARY OF THE INVENTION

The present invention may be summarized as directed to an improved powerized stapling device characterized in that a unique means is employed for varying the force of the stapling stroke, enabling a more precise and wider range of stapling force than is available to powerized staplers utilizing electronic adjustment of stapling force.

The invention is further directed to a variable power-stapling device, which automatically adjusts stapling force to the thickness of the articles to be stapled.

A still further object of the invention resides in the provision of a variable power stapler wherein adjustment of the stapling force functions, in addition, to vary the spacing between the stapler head and the upper most of the stack of sheets to be stapled. More particularly, adjustment of the stapling force to reduce the force also functions to shift the stapler drive head closer to the upper most sheet whereby the time lag between energization and actual driving of a staple is reduced. Conversely, where a large number of sheets are to be connected adjustment of the driving force to increase the same also results in moving the stapler head further from the upper most of the thick stack of articles maximizing inertia applied to the stapler.

The invention is further directed a unique means for varying the stapling force thereby eliminating the use of electronic controls. Known electronic controls, namely voltage reducers do not function below a threshold voltage eliminating the desired "soft touch" where a limited number of sheets or poly bags are to be stapled. More specifically, adjustment of stapling power in accordance with the invention is accomplished by providing an electromagnetic drive mechanism and particularly a solenoid which includes an armature incorporating a high permeability portion, adjustment of the stapling force being effected by shifting the position of the high permeability portion relative to the core of the solenoid. For example, where the major portion of the high permeability material is positioned such that it will be drawn into the solenoid upon energization, a greater force is applied to the armature than is the case is where a majority of the high permeability material is already located within the solenoid.

It is an object of the invention to provide a force adjustable stapling device wherein adjustment of the driving force is accompanied by a concomitant movement of the stapler head toward and away from the work.

A further object of the invention is the provision of a variable force stapling device, wherein the driving force is automatically varied responsive to the thickness of the stack of articles to be stapled.

A still further object of the invention is the provision of a means for varying the force applied in a stapling operation by varying the position of an armature with respect to an electromagnetic mechanism operatively coupled to the armature.

BRIEF DESCRIPTION OF THE DRAWINGS

FIG. 1 is a perspective view of a stapler in accordance with the invention.

FIGS. 2*a* and 2*b* are cross-sectional views of improperly driven staples as effected using prior art powerized stapling devices.

FIGS. 5 and 7 are vertical sectional views showing the relative positions of the driver mechanism adjusted respectively for connecting a limited number of sheets and larger number of sheets.

FIGS. 6 and 8 are sectional views respectively illustrating a staple clinched by the device adjusted per FIG. 5 and the device adjusted per FIG. 7.

DETAILED DESCRIPTION OF THE DRAWINGS

Figure 3:
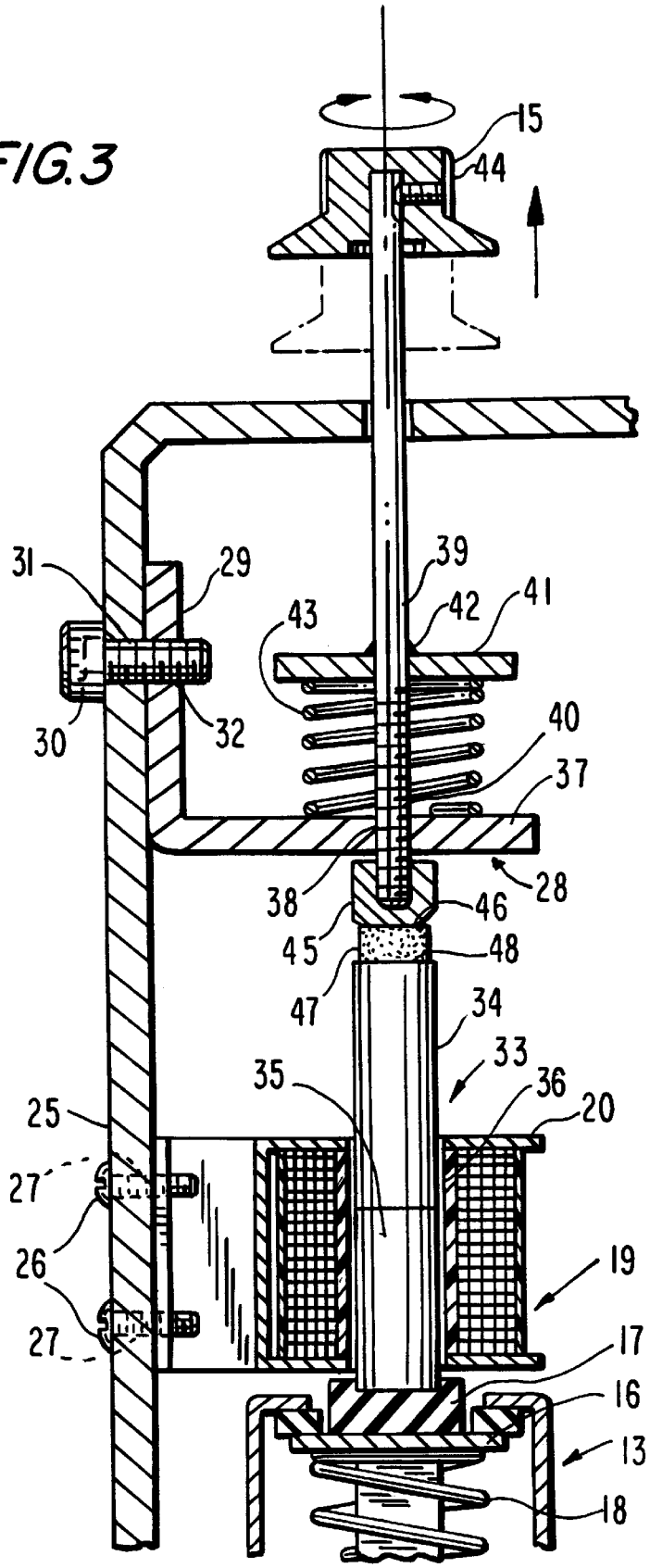
FIG. 3 is magnified cross-sectional view taken on the line 3—3 of FIG. 1.

Referring now to FIG. 1, a force adjustable stapler 10 includes a housing 11 having a base 12 on which is mounted a conventional stapler 13. An adjustment knob 14 carries a microswitch or like trip mechanism (not shown) fixed to the knob 14 enabling the user to adjust the spacing from the edge of the work at which the staple will be applied.

In the embodiment of FIG. 1 the force with which a staple is applied is controlled by force adjustment dial 15.

Figure 4:
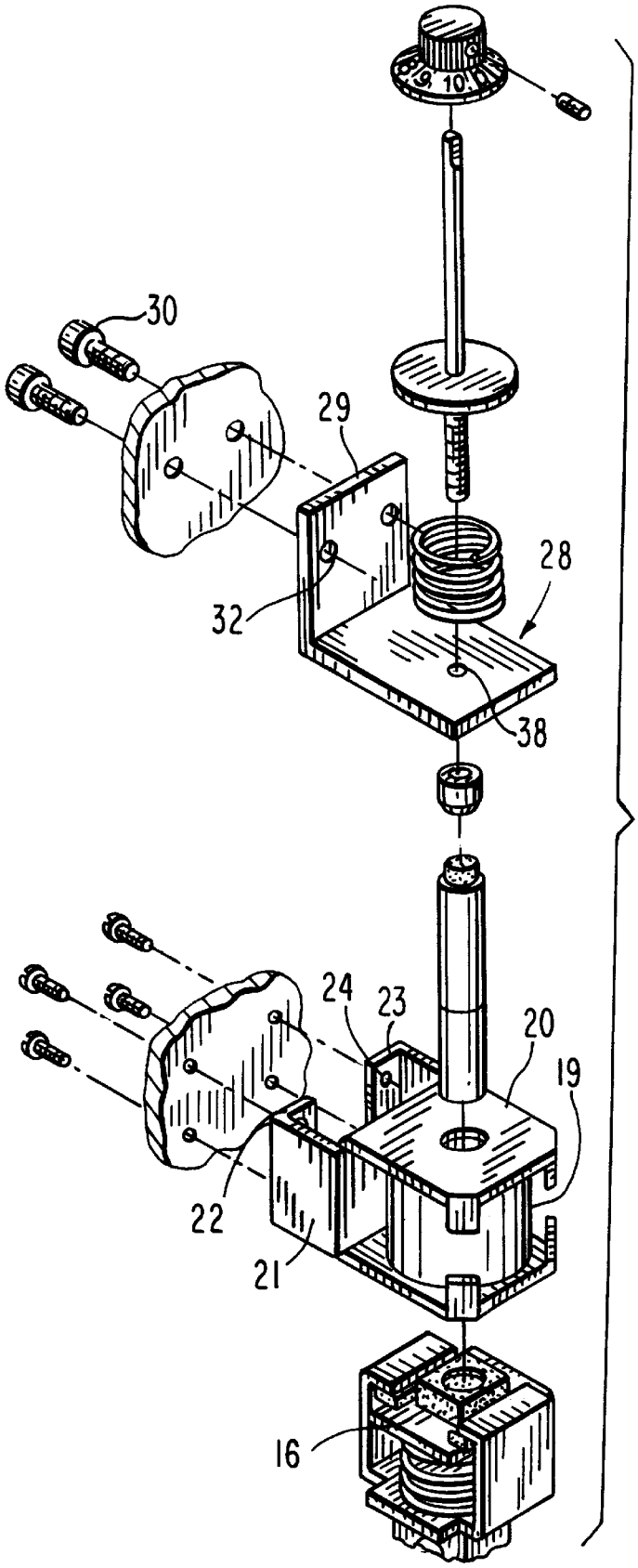
FIG. 4 is an exploded pre-assembly view of the driving mechanism of the stapler.

Details of the force adjustment mechanism are best appreciated from an inspection of FIGS. 3 and 4. The stapler 13 includes a drive head 16 carrying on its upper surface a buffer 17 of felt or elastomer. The head 16 of the stapler is biased upwardly by conventional means such as return spring 18.

Driving power is provided by an electromagnetic assembly, illustratively solenoid 19. Solenoid 19 includes a housing 20 which includes a generally U-shaped mounting bracket 21 including in-turned legs 22,23 (FIG. 4). The legs 22,23 are provided with threaded apertures 24, the bracket 21 being mounted to the side wall 25 of the housing by machine screws 26 passing through apertures 27 in side wall 25 and threaded into the apertures 24 of the bracket 21.

An L-shaped bracket 28 forms a support for the adjustment assembly, the bracket including a vertically directed leg 29 fixed to sidewall 25 of the housing by machine screws 30 passing through apertures 31 in the side wall and extending into complementary threaded apertures 32 in the member 29.

The solenoid 19 includes an armature assembly 33, the assembly being comprised of two components, namely an upper component 34 formed of a high permeability magnetic material such as soft iron and a lower component 35 formed of a low permeability or non-magnetic material such as brass. The armature assembly 33 is vertically movable within the core 36 of the solenoid. Force variation is a function of the position of the high permeability material 34 relative to the core 36 of the solenoid.

More particularly, when the high permeability component 34 is only partially disposed within the core 36 (FIG. 7 and solid line position of dial 15, see FIG. 3) energization of the solenoid 19 will draw the high permeability component downwardly until essentially the entirety of the component 34 enters the core 36. When the component 34 is adjusted downwardly to the position of FIG. 5 and the dot and dash position (FIG. 3) in a manner hereinafter described, the element 34 will move downwardly upon energization of the solenoid 19, only a relatively small additional distance, i.e. until the balance of the high permeability component in introduced into the core 36.

The mechanism for adjusting the relative position of the high permeability portion 34 relative to core 36, i.e. the force adjustment mechanism will next be described.

Bracket 28 includes a generally horizontally directed leg 37 having formed therein a threaded aperture 38. An adjustment rod 39 includes a threaded lower portion 40 threadedly mounted in aperture 38. A circular flange 41 is welded as at 42 to the rod 39, coil spring 43 being biased between the leg 37 and flange 41.

Force adjustment knob 15 is keyed to rod 39 as by set screw 44.

The adjustment rod 39 carries a thrust cap 45 at the lower end of the rod, the base 46 of the cap bearing against pad 47 bonded to the upper surface 48 of the high permeability portion 34 of the armature assembly 33. The pad 48 is preferably formed of a somewhat compressible material such as a heavy felt, neoprene or like elastomer.

As will be apparent from the preceding description, by rotating the force adjustment dial 15 in a manner to thread rod 39 in a downward direction (see dot and dash condition FIG. 3) two complementary functions, each of which reduce the driving force of the stapler, are simultaneously effected.

More particularly, increments of the high permeability portion 34 of armature assembly 33 are introduced into the solenoid coil and at the same time, the inert component 35 of the armature assembly forces pad 17 downwardly moving the stapler head 16 closer to the anvil 50 of the stapler.

As will be appreciated, upon energization of the solenoid 19 the armature assembly 33 will always move to a predetermined lowermost position. However, the force imparted to the stapler head will vary from a maximum force wherein virtually the entirety of the high permeability component 34 is drawn into the solenoid to a minimum force wherein the majority of the high permeability portion is already situated within the core 36 of the solenoid.

The described force adjustment mechanism has the further advantage, where minimal force is desired, as for connecting a limited number of sheets, of bringing the head of the stapler close to the anvil whereby the time lag between penetration and clinching of a staple which passes through only a few sheets is minimized.

In FIG. 2*a* there is illustrated a staple S which has been applied with unduly high force. As is apparent, the staple legs are curved upwardly and the staple ends may penetrate the uppermost surface of the work providing minimal support for the lowermost sheet, the uppermost portion of the staple often being forced through the uppermost sheet.

In FIG. 2*b* there is illustrated the rolling effect which results from staple S' being applied while the work piece is still moving after energizing of the switch mechanism triggering a stapling cycle. The rolling or angular configuration assumed by the staple relative to the work piece is a result of the relatively long time lag resulting from the fact that the stapler head must move through a large arc before clamping the work piece, where only a few sheets are to be processed. This results in a staple in which spaces are formed between the back of the staple and the work on the top surface and between the legs and the under surface as shown.

Referring to FIG. 5, the device has been adjusted to process a limited number of layers L. In this adjusted position it will be observed that the distance D between the stapler head and anvil 50 is smaller than the distance D' (FIG. 7) where the device has been adjusted to apply maximum force. The relative positions of the parts may also be appreciated by noting the close spacing of the arrows 5—5 in FIG. 5 and the greater spacing of the arrows 7—7 of FIG. 7.

FIGS. 6 and 8 illustrate the ideal clinching obtained by utilizing the adjustments provided by FIGS. 5 and 7 respectively.

Figure 9:
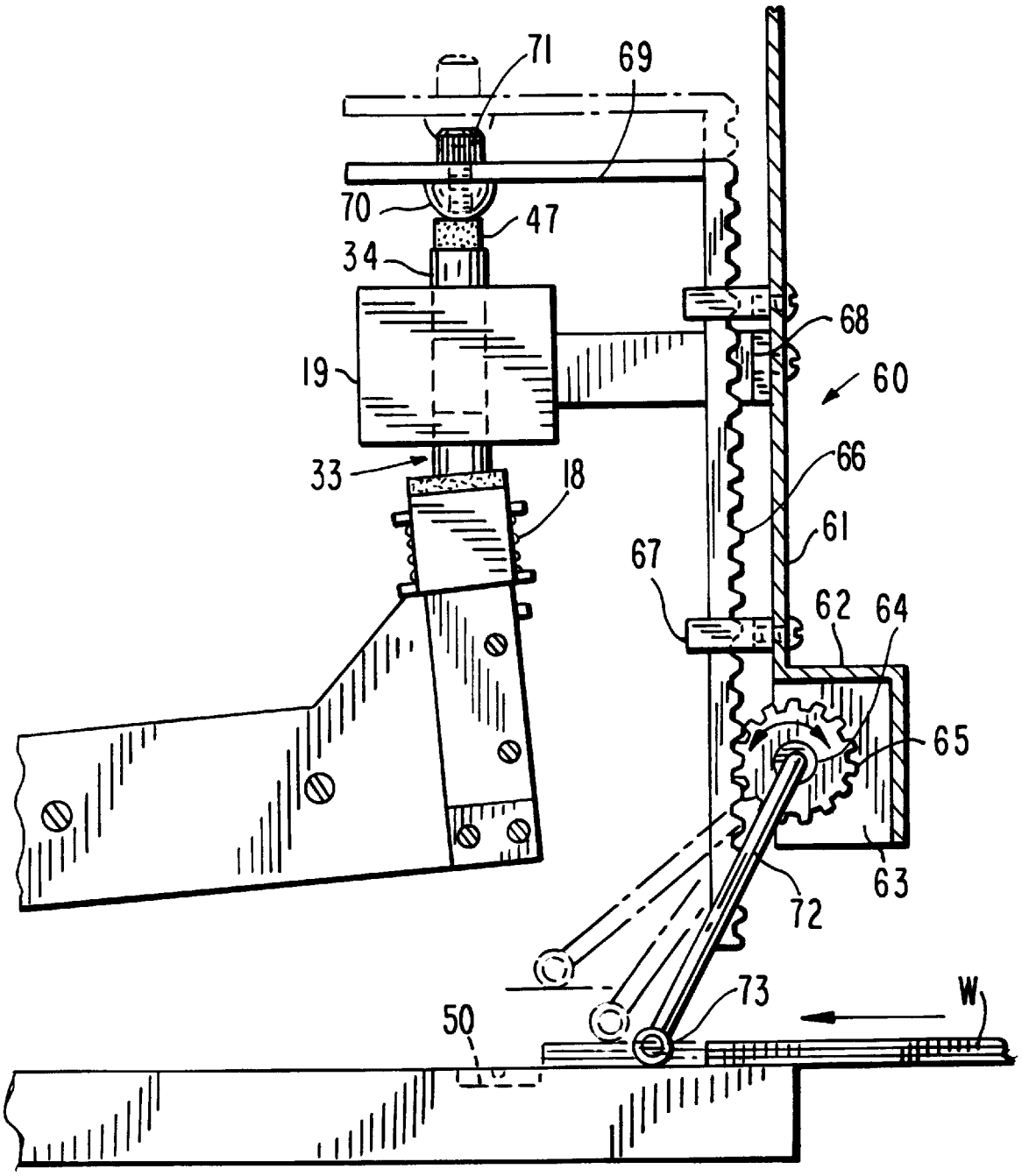
FIG. 9 is a vertical cross-section of an embodiment of the invention incorporating an automatic thickness adjustment.
Figure 10:
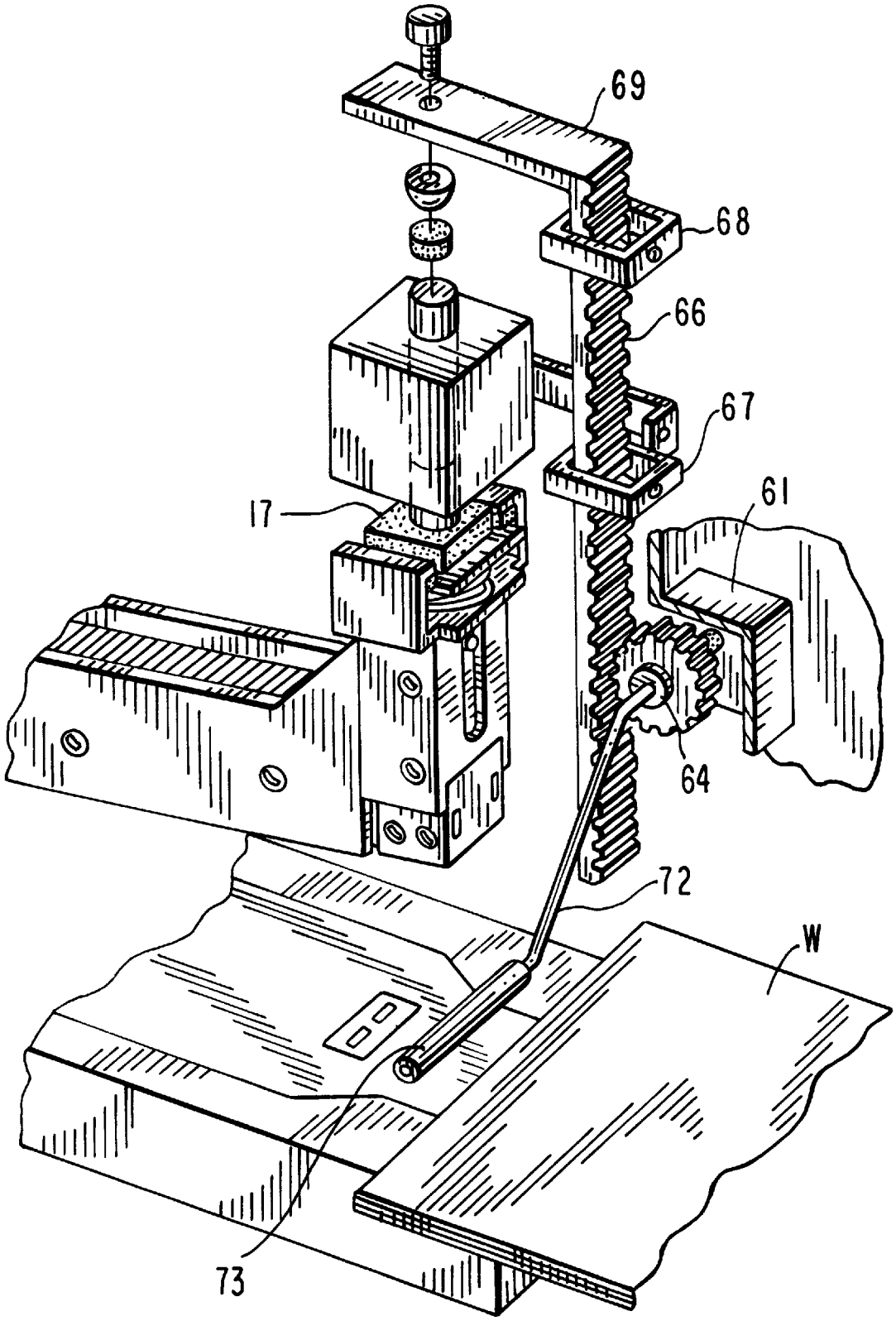
FIG. 10 is an exploded perspective view of the embodiment of FIG. 9.

In FIGS. 9 and 10 there is illustrated an embodiment of the invention which provides automatic adjustment of the applied force in accordance with the thickness of the work to be stapled Referring now to FIGS. 9 and 10, force adjustment previously effected by adjustment of the control knob 15 is automatically accomplished in accordance with the thickness of the work to be stapled by an automatic adjustment mechanism referred to generally by reference numeral 60. The solenoid 19 and armature assembly 33 are essentially identical to the device of the previously described embodiment. The housing front wall 61 includes an extension 62 to the side wall 63 on which is rotatably mounted an adjustment shaft 64. The shaft 64 carries a pinion gear 65 which meshes with rack 66 guided for vertical movement by rack support brackets 67,68 bolted to housing wall 61. The rack includes a drive arm 69 superposed over the high permeability component 34 of the armature assembly 33.

Drive nut 70 is clamped to arm 69 as by machine screw 71, the lower surface of the drive nut being in contact with buffer pad 47 fixed to the armature component 34.

The shaft 64 includes an offset lever arm 72 on which is mounted a sensor roller 73 horizontally disposed in the path of the work W to be stapled. As is apparent from FIGS. 9 and 10, the work piece W when inserted past the sensor roller 73 will cause the shaft 64 to rotate in a clockwise direction lifting rack 66. Contact between the pad 17 and the undersurface of the non-permeable armature component 34 is maintained by the upward springing force provided by spring 18 of the stapler.

As will be apparent by comparing the solid and dot and dash positions of the components as shown in FIG. 9, the thicker the work piece W the greater the rotation of the pinion gear 65 and concomitantly the greater the spacing the stapler from anvil 50. Similarly, the high permeability portion 34 will be withdrawn from the core of the solenoid 19 providing maximum driving force and travel of the armature assembly within the solenoid core.

As will be apparent, insertion of a thin work piece will shift roller 73 only slightly in a clockwise condition permitting the stapler head to shift only slight distance upwardly whereby the major mass of the high permeability component will remain within the solenoid providing a relatively short stroke of the armature assembly when the solenoid is energized.

It will thus be recognized that the automatic adjustment assembly described controls both the spacing of the stapler from the work piece and also the force generated by the electromagnetic device upon energizing the coil 19.

From the foregoing, it will be appreciated that there is described in accordance with the invention a powerized stapler device characterized in that the force with which a staple is driven may be accurately controlled, whereby greater forces are applied where a thick work piece is processed than is the case where the work piece is comprised of only a few sheets or, a readily deformed material such as a polyethylene bag.

A further characterizing feature of the invention resides in the device controlling both the force generated by the electromagnetic drive mechanism and also by a shifting of position of the stapler head toward and away from the work piece in accordance with the desired stapling result.

A further feature of the invention resides in mechanically controlling the force exerted by the electromagnetic drive mechanism as a function of the adjusted position of the high permeability component of the armature mechanism relative to the electromagnetic device.

A still further characterizing feature of the invention resides in a device which automatically senses the thickness of the work load to be stapled and accordingly adjusts both the position of the stapler head and the force with which the stapler is driven.

As will be apparent to those skilled in the art and familiarized with the instant disclosure numerous variations in structural details may be made without departing from the spirit of the invention. Accordingly, the invention is to be broadly construed within scope of the appended claims.

I/we claim:

1. A variable force powerized stapler assembly comprising a housing having a base, a stapler mounted on said base including a drive head shiftable toward and away from said base, drive means including an electromagnet mounted on said housing for actuating said stapler through an operative cycle, said drive means including an armature assembly having a high permeability portion and an extension engaging said drive head and adjustment means operatively associated with said armature assembly, said adjustment means including sensor means on said base responsive to the thickness of articles to be stapled for shifting the position of said high permeability portion relative to said electromagnet to thereby vary the force imparted to said armature upon energization of said electromagnet responsive to the sensed thickness of said articles.

2. Apparatus in accordance with claim 1, wherein said sensor means comprises a lever fixed to said housing and pivotally movable about a horizontal axis, an abutment on said lever positioned in the path of articles advanced beneath said drive head and coupling means interposed between said lever and said armature assembly for shifting said armature assembly toward and away from said base in accordance with the extent of pivotal movement of said lever.

3. Apparatus in accordance with claim 2, wherein said coupling means comprises a pinion mounted on said lever and a rack meshed with said pinion.

4. Apparatus in accordance with claim 1, wherein said electromagnet comprises a solenoid having a core and said armature assembly is axially movably mounted within said core.

5. Apparatus in accordance with claim 1, wherein said drive head of said stapler is shifted toward and away from said base in accordance with the adjusted position of said armature assembly relative to said electromagnet.

6. A variable force powerized stapler assembly comprising a housing having a base, a stapler mounted on said base including a drivehead shiftable toward and away from said base, drive means including an electromagnet mounted on said housing for actuating said stapler through an operative cycle, said drive means including an armature assembly having a high permeability portion and an extension engaging said drivehead, and adjustment means operatively associated with said armature assembly, said adjustment means including sensor means on said base responsive to the thickness of articles to be stapled for shifting said high permeability portion and said drivehead toward and away from said base in accordance with the position of said adjustment means to thereby vary the force imparted to said stapler head upon energization of said electromagnet.

7. Apparatus in accordance with claim 6, wherein said sensor means comprises a lever mounted on said housing for pivotal movement about a horizontal axis, an abutment on said lever positioned in the path of articles advanced beneath said drive head and coupling means interposed between said lever and said armature assembly for shifting said armature assembly toward said base in accordance with the extent of pivotal movement of said lever.

8. Apparatus in accordance with claim 7, wherein said coupling means comprises a pinion mounted on said lever and a rack coupled to said armature assembly and meshed with said pinion.

9. Apparatus in accordance with claim 6, wherein said electromagnet comprises a solenoid having a core and said armature assembly is axially movable within said core.

* * * * *